US008919157B2

(12) United States Patent
Fantl et al.

(10) Patent No.: US 8,919,157 B2
(45) Date of Patent: Dec. 30, 2014

(54) LOCK ASSEMBLY WITH REMOVABLE SHACKLE

(75) Inventors: Steven A. Fantl, Colgate, WI (US); Patrick Smith, Birmingham, MI (US)

(73) Assignee: Solidbody Technology Company, Troy, MI (US)

( * ) Notice: Subject to any disclaimer, the term of this patent is extended or adjusted under 35 U.S.C. 154(b) by 896 days.

(21) Appl. No.: 12/835,056

(22) Filed: Jul. 13, 2010

(65) Prior Publication Data

US 2010/0269550 A1 Oct. 28, 2010

Related U.S. Application Data

(63) Continuation of application No. 11/690,241, filed on Mar. 23, 2007.

(60) Provisional application No. 60/785,333, filed on Mar. 23, 2006.

(51) Int. Cl.

| | |
|---|---|
| ***E05B 67/22*** | (2006.01) |
| ***E05B 67/24*** | (2006.01) |
| ***E05B 63/00*** | (2006.01) |
| ***E05B 67/06*** | (2006.01) |
| *E05B 17/00* | (2006.01) |
| *E05B 67/00* | (2006.01) |

(52) U.S. Cl.

CPC ..... *E05B 67/24* (2013.01); *E05B 63/0056* (2013.01); *E05B 67/063* (2013.01); *E05B 17/0062* (2013.01); *E05B 67/003* (2013.01)

USPC ..... 70/39; 70/38 A; 70/38 B

(58) Field of Classification Search

USPC ..... 70/38 A, 38 B, 38 C, 39, 40, 422

See application file for complete search history.

(56) References Cited

U.S. PATENT DOCUMENTS

| | | | | |
|---|---|---|---|---|
| 3,143,872 | A | 8/1964 | Check | |
| 4,183,566 | A | 1/1980 | Yates | |
| 4,528,828 | A | 7/1985 | Poutiainen | |
| 5,174,136 | A | 12/1992 | Thwing | |
| 5,363,678 | A | 11/1994 | Meckbach | |
| 5,377,511 | A | 1/1995 | Meekbach | |
| 5,896,761 | A * | 4/1999 | Chen | 70/38 A |
| 6,813,913 | B2 | 11/2004 | Watts | |
| 7,036,344 | B2 | 5/2006 | Gast et al. | |
| 2002/0007654 | A1 | 1/2002 | Watts | |
| 2007/0240459 | A1 * | 10/2007 | Fantl et al. | 70/38 A |

FOREIGN PATENT DOCUMENTS

| | | | |
|---|---|---|---|
| AU | 51912/93 | A | 10/1994 |
| AU | 52587/93 | A | 1/1995 |

* cited by examiner

*Primary Examiner* — Christopher Boswell

(74) *Attorney, Agent, or Firm* — Carlson, Gaskey & Olds

(57) ABSTRACT

A lock assembly includes a lock body with a shackle. The shackle has a leg. A locking element is disposed in the lock body and is selectively engageable to the shackle. A cam is disposed in the lock body and includes a locked position, an unlocked position and a shackle removal position. The leg includes a shackle removal recess that only partially extends circumferentially about an outer peripheral surface disposed about a longitudinal axis of the leg and is sized to receive the first locking element sufficiently to permit movement of the cam to the shackle removal position. The shackle is rotatable in the unlocked position to expose the shackle removal recess to the locking element.

14 Claims, 6 Drawing Sheets

LOCK ASSEMBLY WITH REMOVABLE SHACKLE

CROSS-REFERENCE TO RELATED APPLICATIONS

This application is a continuation of U.S. patent application Ser. No. 11/690,241 filed on Mar. 23, 2007, which claims priority to U.S. Provisional Patent Application 60/785,333, filed on Mar. 23, 2006.

BACKGROUND

A padlock typically has a shackle that engages a lock body. The shackle can be opened and then locked to secure a large variety of different objects, such as doors, gates, bicycles, and fences. Given this variety, different shackle sizes may be required to lock any particular object. Generally, a consumer must purchase a different padlock for each shackle size. Consequently, one padlock for one application may be ill-suited for another, requiring an individual to keep an inventory of different padlocks on hand as well as their associated keys.

It is known to provide lock assemblies with removable shackles. One known design achieves this function through a specially designed cam located within the lock body. The cam has one position for locking the shackle to the lock body. A key may be turned to move the cam to unlock the shackle. Further turning of the cam allows the shackle to be removed. The cam has a deep recess so that the shackle may clear the lock body. However, having this deep recess in the cam may weaken the structural integrity of the lock.

SUMMARY

A lock assembly includes a lock body with a shackle. The shackle has a leg. A locking element is disposed in the lock body and is selectively engageable to the shackle. A cam is disposed in the lock body and includes a locked position, an unlocked position and a shackle removal position. The leg includes a shackle removal recess that only partially extends circumferentially about an outer peripheral surface disposed about a longitudinal axis of the leg and is sized to receive the first locking element sufficiently to permit movement of the cam to the shackle removal position. The shackle is rotatable in the unlocked position to expose the shackle removal recess to the first locking element.

In another exemplary embodiment, a method of distributing a lock assembly includes providing a lock body with a first removable shackle. The first removable shackle includes an engagement feature of a predetermined dimension to mate with the lock body and a shackle removal recess that that only partially extends circumferentially about an outer peripheral surface disposed about a longitudinal axis of a first leg of the removable shackle. A second removable shackle is packaged with the first removable shackle and the lock body. The second removable shackle is different from the first removable shackle and is provided with the engagement feature and the shackle removal recess.

In another exemplary embodiment, a lock assembly includes a lock body with a shackle. The shackle has a leg. A locking element is disposed in the lock body and is selectively engageable to the shackle. A cam is disposed in the lock body and includes a first recess, a second recess, a third recess and a fourth recess each circumferentially disposed about an outer peripheral surface of the cam. Each of the first recess, the second recess, the third recess and the fourth recess are selectively engageable to the locking element.

The various features and advantages of this disclosure will become apparent to those skilled in the art from the following detailed description. The drawings that accompany the detailed description can be briefly described as follows.

DETAILED DESCRIPTION

Figure 1:
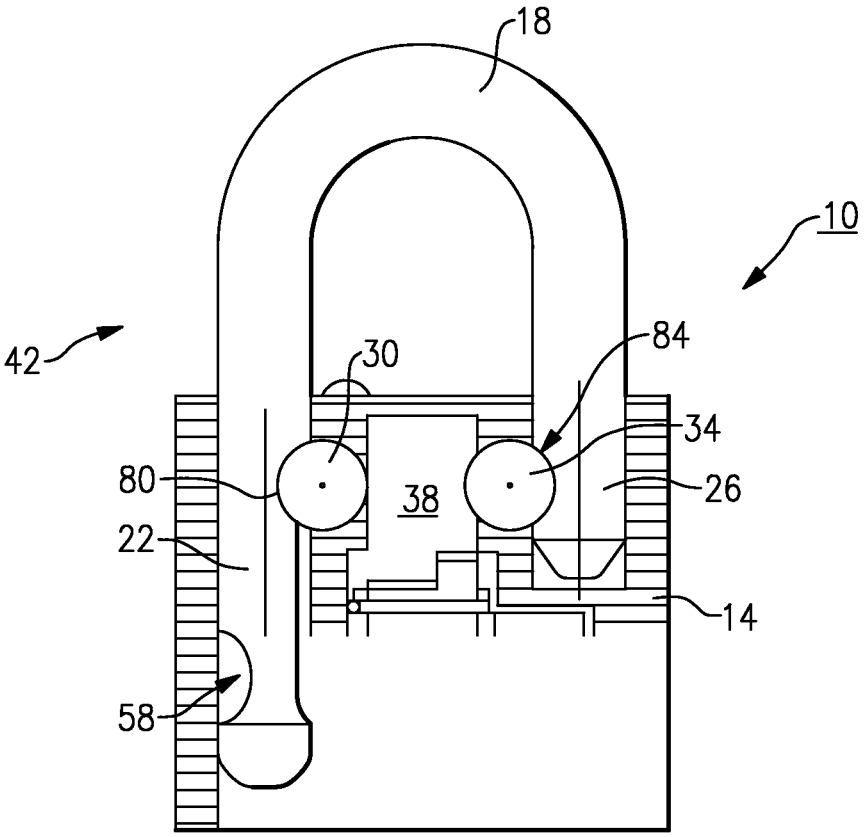
FIG. 1 illustrates a side cross-sectional view of the inventive lock assembly in the locked position, showing shackle, lock body, actuator and locking elements.

FIG. 1 illustrates a side cross-sectional view of inventive lock assembly 10. Lock assembly 10 has lock body 14 in which is disposed shackle 18. Shackle 18 has first leg 22 and second leg 26. Further disposed within lock body 14 is first locking element 30 and second locking element 34, here ball bearings. First locking element 30 and second locking element 34 are shown in contact with actuator 38, here a cam, which is shown in locked position 42.

Figure 2:
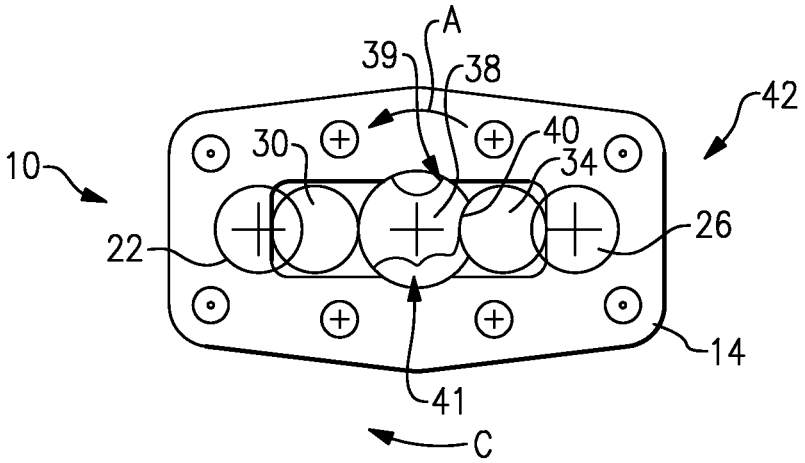
FIG. 2 illustrates an overhead cross-sectional view of the lock assembly of FIG. 1, showing actuator in the locked position.

As shown in FIG. 2, actuator 38 has three recesses: first recess 39, second recess 40 and third recess 41. As shown, second recess 40 is the shallowest while third recess 41 is the deepest. First recess 39 is between second recess 40 and third recess 41 in depth. Each recess is a scallop of actuator 38, which is rotatable within lock body 14 so that different recesses may be presented to first locking element 30 and second locking element 34 as will be explained.

FIGS. 1 and 2 show lock assembly 10 in a locked condition. Here actuator 38, as shown in FIG. 2, displaces first locking element 30 and second locking element 34 into lock recess 80 and lock recess 84 of shackle 18 as known. In this locked condition, shackle 18 is locked to lock body 14 through the engagement of first locking element 30 and second locking element 34.

Figure 3:
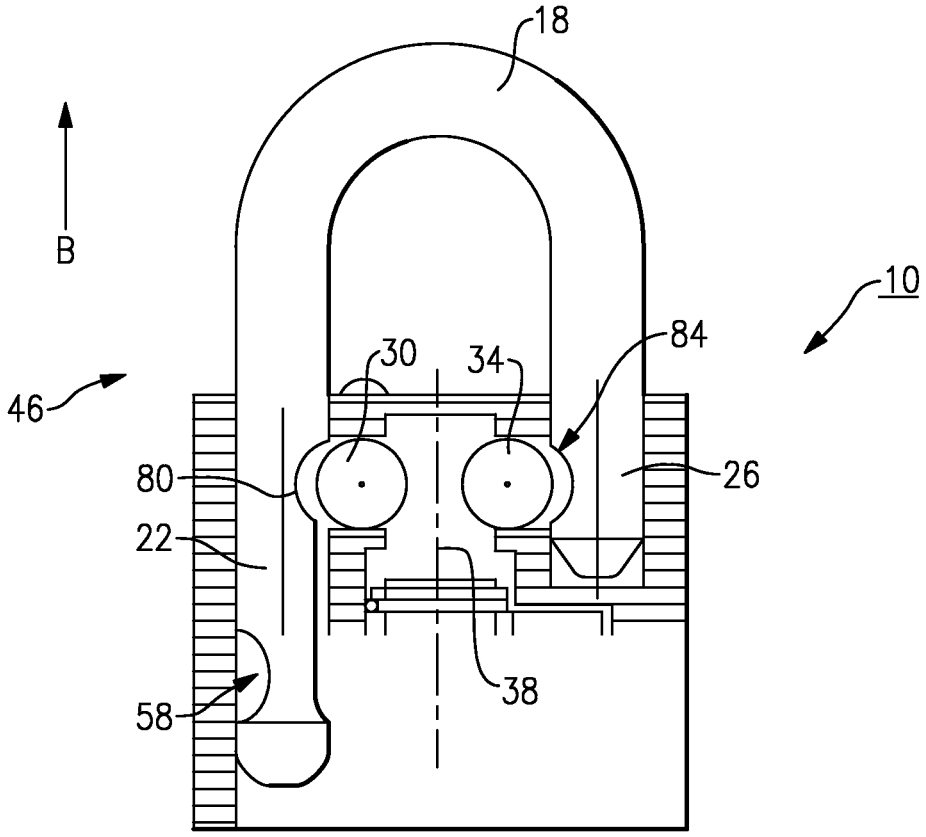
FIG. 3 illustrates a side cross-sectional view of the lock assembly of FIGS. 1 and 2 in the unlocked position.
Figure 4:
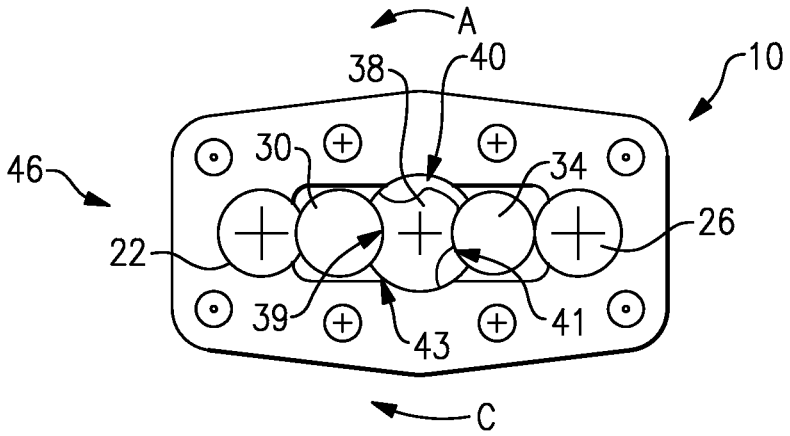
FIG. 4 illustrates an overhead cross-sectional view of the lock assembly of FIG. 3 with actuator in the unlocked position.
Figure 5:
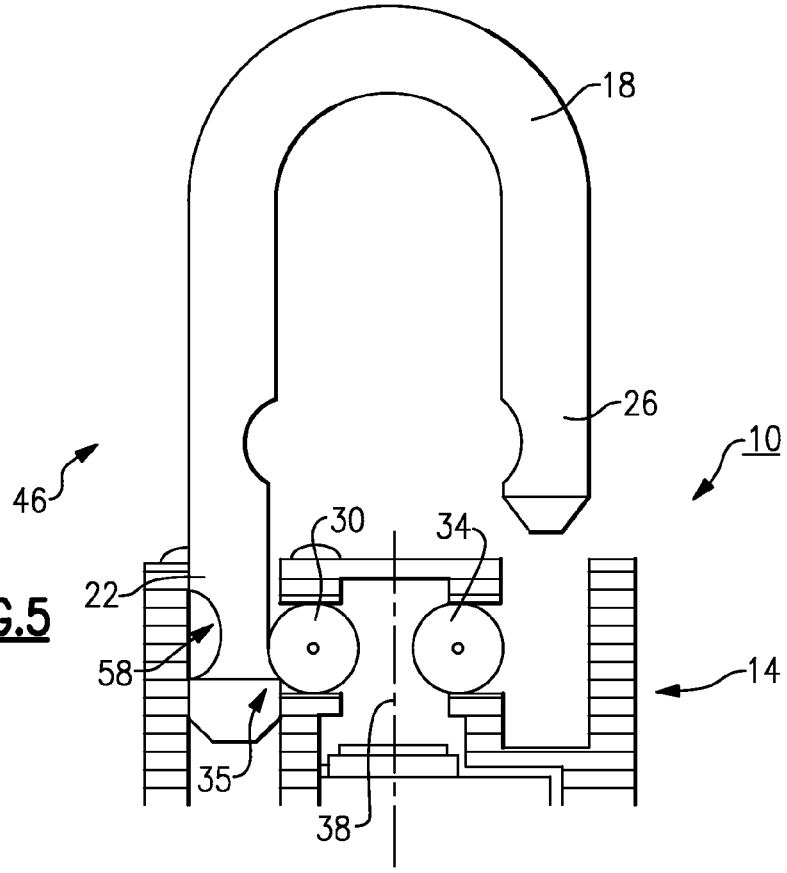
FIG. 5 illustrates a side cross-sectional view of the lock assembly of FIG. 3 with shackle lifted from the lock body.

To unlock lock assembly 10, actuator 38 is turned, such as by key, from locked position 42 shown in FIG. 2 to unlocked position 46 shown in FIG. 4 by turning actuator 38 in the direction of arrow A. When actuator 38 is in unlocked position 46, first locking element 30 and second locking element 34 disengage shackle 18 as shown in FIG. 3 because first locking element 30 and second locking element 34 are received in first recess 39 and third recess 41 thereby bringing locking elements 30, 34 away from lock recesses 80, 84. Here, shackle 18 may be moved in the direction of arrow B to the position shown in FIG. 5. Shackle 18 has skirt 35 that prevents shackle 18 from being lifted completely out of lock body 14. From this position, lock assembly 10 is now open to secure objects as known.

Figure 6:
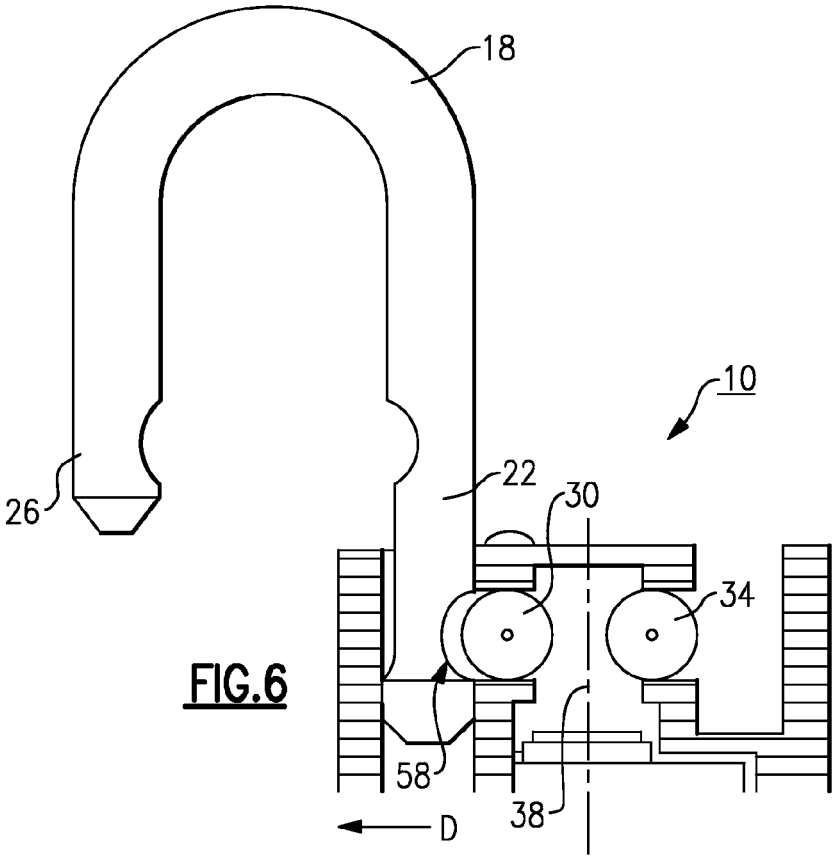
FIG. 6 illustrates the lock assembly of FIG. 5 with shackle turned to expose shackle removal recess to a locking element.
Figure 7:
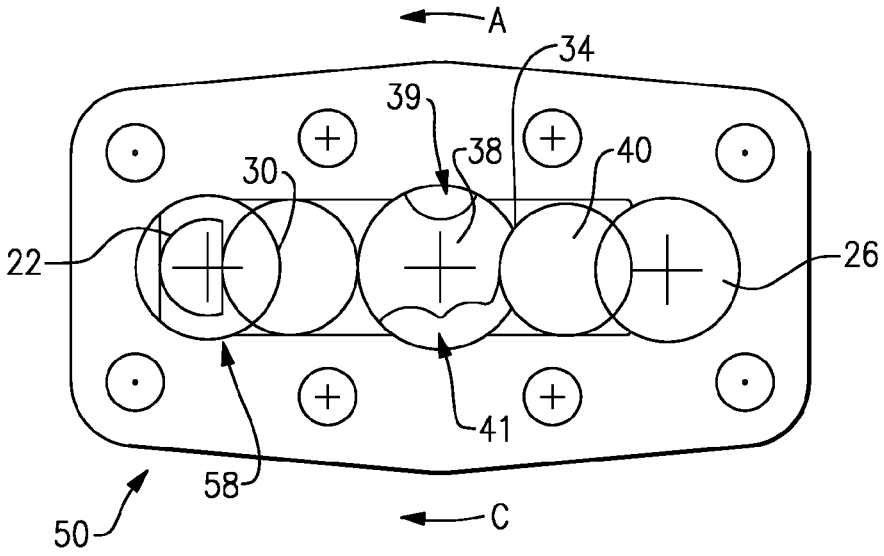
FIG. 7 illustrates an overhead view of the lock assembly of FIG. 6 with locking element displaced into shackle removal recess.
Figure 8:
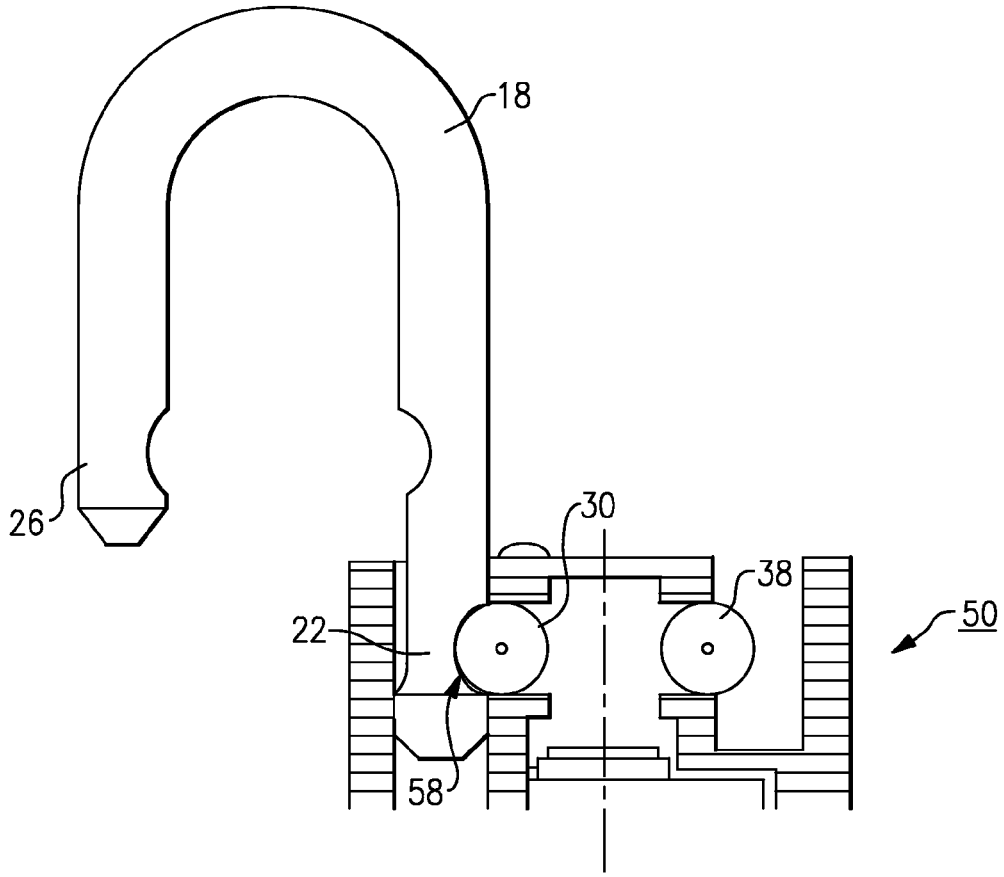
FIG. 8 illustrates a side cross-sectional view of the lock assembly of FIG. 7, with locking element displaced into shackle removal recess.
Figure 9:
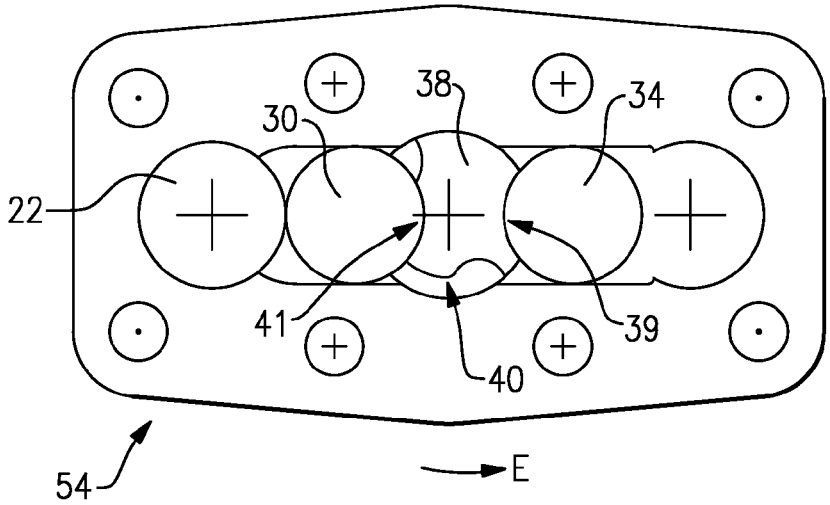
FIG. 9 illustrates an overhead cross-sectional view of the inventive lock assembly with cam in the shackle removal position.
Figure 10:
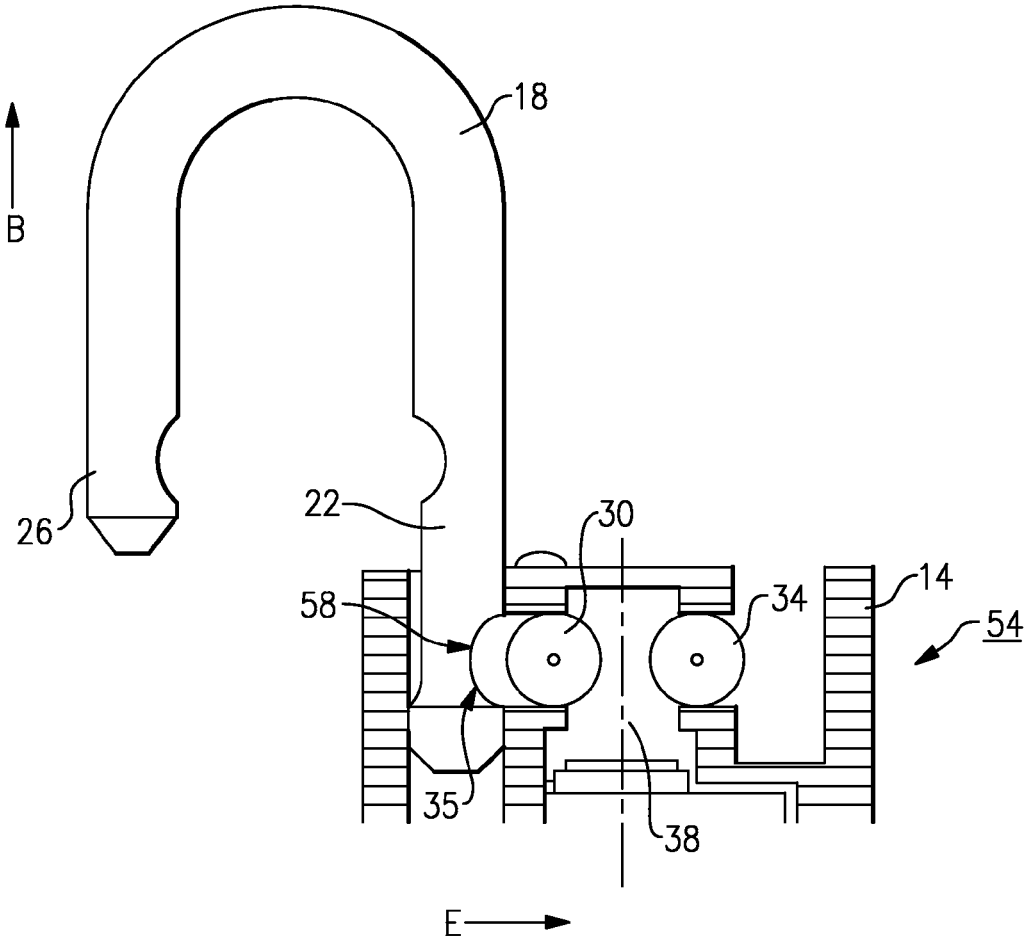
FIG. 10 illustrates lock assembly of FIG. 9 with shackle now released for removal from the lock body.

It may be desirable to replace shackle 18 with another shackle. To remove shackle 18 from locked body 14, shackle 18 is rotated so as to expose shackle removal recess 58 to first locking element 30 as shown in FIG. 6. Shackle 18 may be turned in the direction of arrow A or in the opposite direction of arrow C as shown in FIG. 2. Prior to turning of shackle 18 to expose shackle removal recess 58, shown in FIG. 4, the position of locking element 30 prevents actuator 38 from turning in the direction of either arrow A or arrow C. With shackle 18 now exposing shackle removal recess 58 to locking element 30, locking element 30 has space to move in the direction of arrow D into shackle removal recess 58, which is sized to receive part of locking element 30 as seen in FIGS. 7 and 8. With reference to these figures, locking element 30 may be displaced into shackle removal recess 58 by rotating actuator 38 to locking element displacement position 50 in the direction of arrow C. As shown in FIG. 7, locking element 30 has moved into shackle removal recess 58 because of the action of edge 43 of actuator 38 rotating in the direction of arrow C. As shown in FIG. 7, shackle removal recess 58 is deep enough to receive enough of first locking element 30 so that actuator 38 may turn in the direction of arrow C to locking element displacement position 50. From there, actuator 38 may be turned further in the direction of arrow C to shackle removal position 54, as shown in FIG. 9, exposing third recess 41, the deepest recess, to first locking element 30. Locking element 30 moves in the direction of arrow E into third recess 41, thereby moving completely out of the path of skirt 35 as shown in FIG. 10 to permit shackle 18 to be removed in the direction of arrow B completely from lock body 14. In this way, lock assembly 10 allows for the removal of shackle 18 without weakening its structural integrity.

Figure 11:
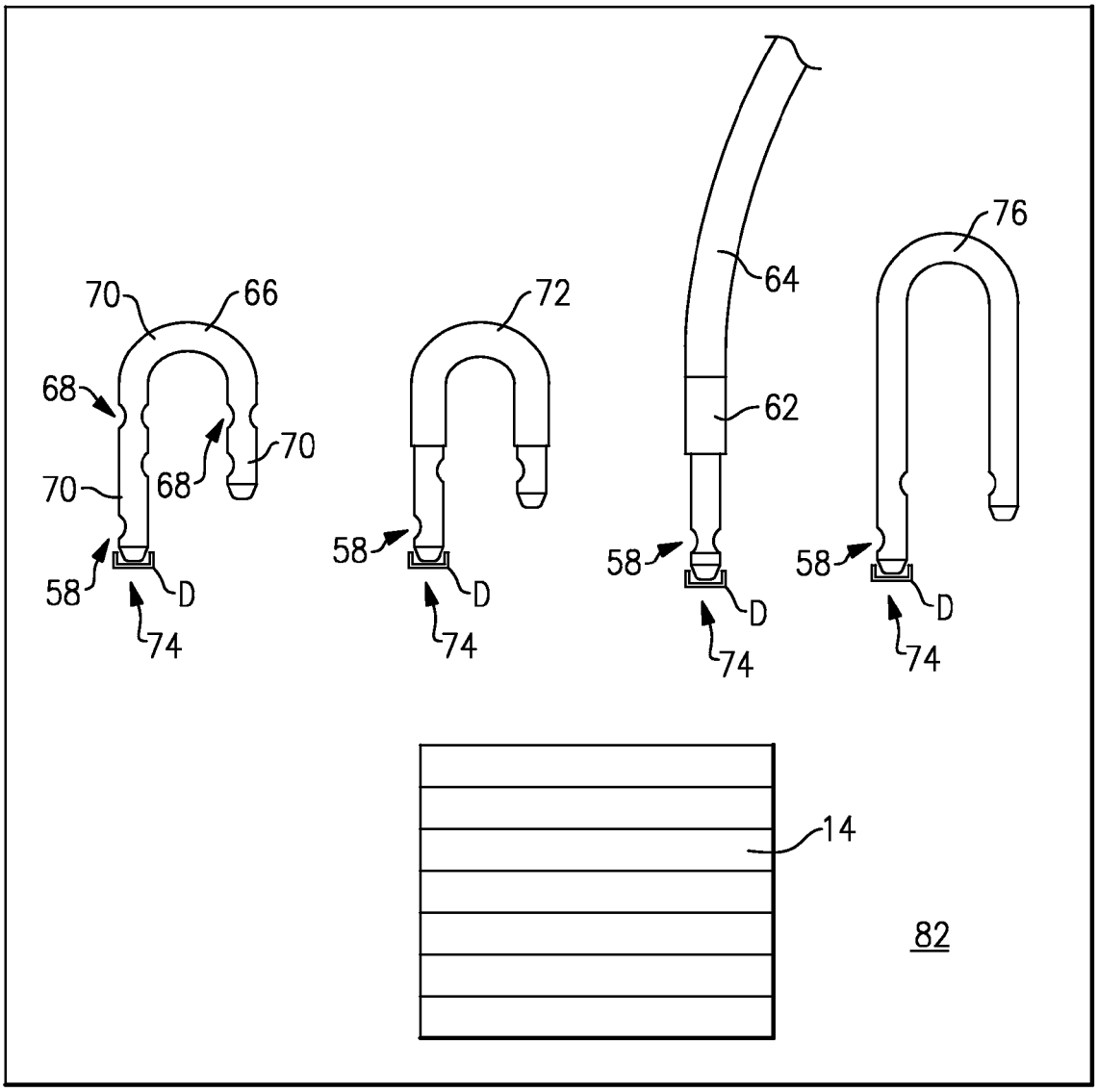
FIG. 11 illustrates an inventive distribution technique.

As shown in FIG. 11, to provide convenience to users of lock assembly 10, lock body 14 may be packaged in package 82 with a variety of shackles as shown. For example, shackle 62 with cable 64 may be part of package 82 along with shackle 66, shackle 72 and shackle 76. Shackle 62 has cable 64 in contrast to the other shackles. Shackle 72 is shorter than shackle 76 as shown. Shackle 70 has weakened area 68 to permit shackle 66 to be broken with sufficient force if necessary to unlock the lock without a key. Further, shackle 72 may be made from a different material or with a different hardness then shackle 74. One material may be a standard hardened steel while the other a specialty alloy. Remainder 70 of shackle is unweakened. Shackles 62, 66, 72 and 76 are all provided shackle removal recess 58 and with engagement feature 74 having predetermined size D, which is sized to be received in lock body 14 in the manner shown in FIGS. 1-10. In this way, a single lock body may be used with multiple shackles of differing sizes and differing functions.

The aforementioned description is exemplary rather that limiting. Many modifications and variations of the present disclosure are possible in light of the above teachings. The preferred embodiments of this disclosure have been disclosed. However, one of ordinary skill in the art would recognize that certain modifications would come within the scope of this disclosure. Hence, within the scope of the appended claims, the invention may be practiced otherwise than as specifically described. For this reason the following claims should be studied to determine the true scope and content of this disclosure.

We claim:

1. A lock assembly comprising:
a lock body;
a shackle having a first leg;
a first locking element disposed in said lock body, said first locking element selectively engageable to said shackle;
a cam disposed in said lock body; and
wherein said first leg has a shackle removal recess that only partially extends circumferentially about an outer peripheral surface disposed about a longitudinal axis of said first leg and is sized to receive said first locking element sufficiently so as to permit movement of said cam to a shackle removal position.

2. The lock assembly as recited in claim 1, wherein said cam has a locking element displacement position that displaces said first locking element into said shackle removal recess.

3. The lock assembly as recited in claim 1, wherein said cam is configured so that from a locked position, said cam must move to an unlocked position, then to a locking element displacement position prior to movement to said shackle removal position.

4. The lock assembly as recited in claim 1, wherein said shackle removal recess is exposed to said first locking element only subsequent to rotating said shackle 180°.

5. The lock assembly as recited in claim 1, wherein said shackle is removable from said lock body without removal of any other portion of said lock body.

6. The lock assembly as recited in claim 1, wherein said shackle removal recess is non-continuous about said outer peripheral surface.

7. The lock assembly as recited in claim 1, wherein said cam includes a first recess, a second recess, a third recess and a fourth recess each selectively engageable to said first locking element.

8. The lock assembly as recited in claim 1, wherein said shackle removal recess is non-symmetric about said longitudinal axis of said first leg.

9. A method of distributing a lock assembly, comprising the steps of:
providing a lock body with a first removable shackle having an engagement feature of a predetermined dimension to mate with the lock body and a shackle removal recess that only partially extends circumferentially about an outer peripheral surface disposed about a longitudinal axis of a first leg of the removable shackle;
packaging a second removable shackle with the first removable shackle and the lock body, the first removable shackle different from the second removable shackle; and
providing the second removable shackle with the engagement feature and the shackle removal recess.

10. The method as recited in claim 9, comprising the step of:
providing the first removable shackle with a cable and providing the second removable shackle without a cable.

11. The method as recited in claim 9, comprising the step of:
disposing a cam within the lock body, wherein the cam includes a first recess, a second recess, a third recess and a fourth recess each selectively engageable to a locking element.

12. The method as recited in claim 9, comprising the step of:

removing the first removable shackle from the lock body without removing any other portion of the lock body.

13. A lock assembly, comprising:

a lock body;

a shackle having a leg;

a locking element disposed in said lock body, said locking element selectively engageable to said shackle;

a cam disposed in said lock body, wherein said cam includes a first recess, a second recess, a third recess and a fourth recess each selectively engageable to said locking element; and wherein said leg has a shackle removal recess that only partially extends circumferentially about an outer peripheral surface disposed about a longitudinal axis of said leg.

14. The lock assembly as recited in claim 13, wherein each of said first recess, said second recess, said third recess and said fourth recess extend radially inwardly from an outer peripheral surface of said cam.

* * * * *